United States Patent [19]

Murphy et al.

[11] 4,029,288

[45] June 14, 1977

[54] CONCRETE FORM BRACKET

[76] Inventors: Ivin S. Murphy, 9207 Solena Way; Melvin H. Murphy, 9916 S. 2600 East, both of Sandy, Utah 84070

[22] Filed: Jan. 5, 1976

[21] Appl. No.: 646,467

[52] U.S. Cl. ..... 249/216; 249/219 R

[51] Int. Cl.[2] ..... E04G 17/06; E04G 17/14

[58] Field of Search ..... 249/2–9; 249/13, 205, 207–208, 210, 219 R, 18, 216; 248/250, 295, 298

[56] References Cited

UNITED STATES PATENTS

| | | | |
|---|---|---|---|
| 733,396 | 7/1903 | Jarvis | 249/9 |
| 1,067,420 | 7/1913 | Forbis | 249/5 |
| 1,607,690 | 11/1926 | Rue | 249/207 |
| 1,810,777 | 6/1931 | McKee | 249/219 R |
| 3,662,985 | 5/1972 | Parker | 249/219 R |

FOREIGN PATENTS OR APPLICATIONS

| | | | |
|---|---|---|---|
| 23897/29 | 12/1930 | Australia | 249/8 |
| 7208/27 | 12/1927 | Australia | 249/2 |
| 887,175 | 11/1971 | Canada | 249/40 |
| 911,349 | 11/1962 | United Kingdom | 249/2 |

*Primary Examiner*—Ronald J. Shore
*Assistant Examiner*—John McQuade
*Attorney, Agent, or Firm*—H. Ross Workman; J. Winslow Young

[57] ABSTRACT

A bracket and method for releasably holding two concrete form walls, the bracket having a horizontal crosspiece with downwardly projecting legs at each end. The legs cooperate with flange means to embrace the form walls to resist lateral movement of the form walls before and while concrete is poured into the space created between the form walls. The bracket includes means to hold (1) the crosspiece above the concrete, (2) the form walls vertically, and (3) the form walls above the ground surface to establish the grade of the form walls.

7 Claims, 7 Drawing Figures

CONCRETE FORM BRACKET

BACKGROUND

1. Field of the Invention

This invention relates to brackets for concrete forms.

2. The Prior Art

Structures of various types require a suitable foundation thereunder in order to prevent subsidence, frost upheaval, and other disturbances of the integrity of the wall structure. Construction of the building foundation is initiated by fabricating a footing in an excavation with the footing following the outline of the proposed load bearing wall structure. Footings are fabricated from concrete with the specific dimensions, height and width, dictated according to the structure to be erected thereupon as directed by the local building ordinance requirements. The top surface of the footing is prepared to establish the grade of the footing.

Conventionally, the concrete footing structure is erected by preparing an outline of the footing with form walls which define the size of the footing structure. The footing form walls are prepared so as to achieve the appropriate width and height of the footing in addition to establishing the appropriate grade for the footing. The grade is initially established with the top edge of the form walls and the footing form is thereafter filled with concrete flush with the top edge of the form walls so that the concrete surface corresponds to the grade as set by the top edge of the form walls.

To establish these various dimensions of the footing form, it has been conventional to use wooden stakes and wooden cross ties in combination with wooden form walls. The footing form walls are usually lengths of standard 2 × 10 or 2 × 12 inch lumber which has been sprayed with a form release agent. Wooden 1 × 2 inch cross ties are nailed to the form walls to provide lateral support while the wooden stakes are driven into the ground to support the form walls against the outward displacement by the hydraulic pressure of the fresh concrete. Where necessary, the stakes are also nailed to the form walls to support the form walls above the ground surface in order to establish the grade of the footing form.

Fluid concrete exerts substantial hydraulic pressure against the form walls which, unless they are adequately braced, will be forced outwardly resulting in slumping, wasted concrete, and loss of footing integrity, particularly with respect to the grade of the footing. To overcome this problem it is conventional to drive additional support stakes into the ground as insurance against the concrete forcing the form walls outwardly.

However, in rocky or hard ground it is extremely difficult to drive wooden stakes into the ground without their splitting and/or otherwise being damaged. Conversely, stakes are readily driven in sandy soil but sandy soil generally does not hold the stakes against the pressure of the concrete with the same undesirable results as set forth hereinbefore.

Furthermore, the foregoing described conventional technique of preparing footings consumes considerable quantities of man-hours with respect to obtaining (a) the correct dimensions of the footing, (b) the proper grade of the footing, and (c) removing the stakes, cross ties and side form walls from the footing when the concrete is set sufficiently. Furthermore, an excessive number of stakes and cross ties are destroyed after only a single use. Additionally, since the concrete is poured and finished flush with the top edges of the form walls, the cross ties nailed to the top edges of the form walls hinder the finishing of the top surface of the concrete adjacent the cross ties.

Numerous devices have been disclosed which are used to maintain the vertical integrity of concrete form walls. These generally include some form of tie arrangement wherein one form wall is physically connected to the corresponding form wall through a tie member. The concrete is poured between the form walls and thereby completely surrounds and embeds the tie member. After the concrete has sufficiently set the ends of the ties are cut leaving the main body of the tie embedded in the concrete while the form walls are removed from the concrete wall. Numerous examples of these types of concrete form ties may be found, for example, in U.S. Pat. Nos. 645,325; 972,036; 1,550,000; 1,712,631; 1,746,298; 1,769,292; and 2,020,515. In each of the foregoing patents, the form tie is specifically designed to remain embedded within the concrete structure. Even in those cases where the form tie would be used on the top surface of the concrete, the tie would still be either flush with or partially embedded in the concrete surface. As such, it is difficult to suitably finish the concrete surface immediately adjacent the tie.

In view of the foregoing it would be a significant advancement in the art to provide a concrete form bracket which securely engages the side form walls to securely hold them in a vertical position and restrain them against the hydraulic pressure of the concrete poured therein. The bracket should also include means for readily accommmodating establishment of the proper width and grade for the form walls and provide means for allowing working of the concrete underneath the crosspiece of the bracket. Such an invention is disclosed herein.

BRIEF SUMMARY AND OBJECTS OF THE INVENTION

The present invention is a bracket for securely engaging concrete form walls so as to hold them in a generally vertical position against inadvertent dislodgement. The bracket readily accommodates various form widths and can be used to establish the grade of the footing while providing ready access to the concrete underlying the crosspiece of the bracket. The bracket is also easily removable and reusable so as to reduce the number of wooden stakes and cross ties required.

It is therefore an object of this invention to provide improvements in concrete form brackets.

An even further object of this invention is to provide a concrete form bracket having structure which accommodates securement of form walls in a vertical position.

An even still further object of this invention is to provide a concrete form bracket having structure which accommodates supporting the crosspiece of the bracket above the top surface of the form walls.

An even still further object of this invention is to provide a concrete form bracket including means within the bracket to assist in establishing the grade of the concrete forms.

These and other objects and features of the present invention will become more fully apparent from the following description and appended claims taken in conjunction with the accompanying drawing.

DETAILED DESCRIPTION OF THE PREFERRED EMBODIMENTS

The invention is best understood by reference to the figures wherein like parts are designated with like numerals throughout.

General

The present invention is a bracket having a crosspiece with two downwardly depending legs at each end. The bracket is superimposed over two vertically oriented form walls, the downwardly depending legs securely supporting form walls against outward movement. Flanges are also included to support the form walls against inward movement. The crosspiece is supported a discrete distance above the top surface of the form walls so as to permit ready access to the concrete thereunder.

The bracket may also be used to establish the grade of the form walls by placing the ends of the legs on the ground surface and driving nails through a plurality of nail holes in the legs and into the form wall to support the form wall against the leg and above the ground. Concrete is prevented from flowing underneath the form wall thus elevated by earth which is placed against the base of the form wall to close the gap between the form wall and the ground surface.

Where necessary, a few supplementary wooden stakes and cross ties may also be used to assist in establishing the grade and to support the form walls, however, by utilizing the bracket embodiments of this invention, the consumption of stakes and cross ties is significantly reduced.

Importantly, with respect to all of the bracket embodiments shown herein, each embodiment advantageously (1) securely engages two side form walls against inward and outward movement of the form walls, particularly when concrete is poured therebetween, (2) supports the particular bracket crosspiece above the top surface level of the concrete thereby permitting working of the concrete surface underneath the crosspiece, the concrete surface being flush with the tops of the form walls, (3) is readily removable and reusable, (4) greatly reduces the number of wooden stakes and wooden crosspieces that must be used and also, where necessary, nailed to the form walls, (5) significantly prolongs the life of the form walls, (6) may also be used to assist in establishing the grade along the top edge of the form walls and (7) significantly reduces the man-hour requirements for assembly and disassembly of the forms.

Figure 1:
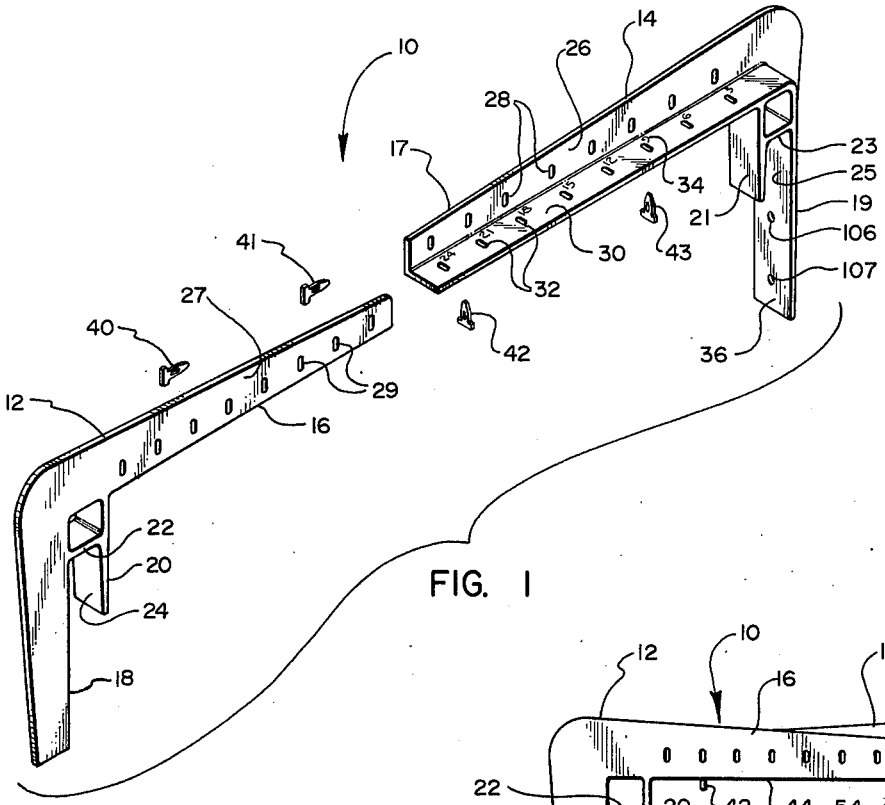
FIG. 1 is an exploded perspective illustration of one presently preferred embodiment of the present invention.

Referring now to FIG. 1, one presently preferred embodiment of the form bracket of this invention is shown generally at 10 and includes two identical bracket halves 12 and 14. Each of bracket halves 12 and 14 are fabricated identically and are merely reversed with respect to each other so as to form a mating configuration to thereby provide the completed bracket 10. The various features of each of respective bracket halves 12 and 14 will be found on the corresponding bracket half, respectively. Accordingly, the description of the various features on each bracket half 12 and 14 will be generally directed to only one bracket half, it being clearly understood that the identical feature is found on the other bracket half.

Bracket half 12 includes a cross arm 16 and a downwardly depending leg 18 at one end thereof. The bracket half 12 forms a right angle at the inside junction between cross arm 16 and leg 18. Depending downwardly from cross arm 16 is flange 20 which is essentially parallel to the inside surface of leg 18 and which is also slightly tapered downwardly for purposes of strength and rigidity. A brace 22 extends horizontally between flange 20 and leg 18 and is located an incremental distance downwardly from cross arm 16. Brace 22 serves to (1) lend additonal strength and rigidity to flange 20 and (2) rest on the top edge (not shown) of a form wall inserted into space 24 between flange 20 and leg 18 (as will be discussed more fully hereinafter particularly with respect to FIG. 4) to hold cross arm 16 above the form walls and the concrete surface.

Directing attention particularly to the bracket half 14 shown as the right bracket half, cross arm 17 and leg 19 are fabricated from material similar to a conventional angle iron with a vertical face 26 and a horizontal face 30. Vertical face 27 includes a plurality of spaced apertures 28. Spaced apertures 32 are also found in horizontal face 30. Suitable indicia are schematically represented herein at 34 and are included with the corresponding apertures to assist the personnel (not shown) in establishing the appropriate distance separation between the vertically oriented legs 18 and 19 when bracket 10 is superimposed over form walls as will be discussed more fully hereinafter.

A plurality of conventional wedge pins 40–43 are provided and are adapted to be accommodated by the plurality of apertures 28 and 32 for the purpose of releasably locking bracket halves 12 and 14 together to form the bracket 10. Wedge pins 40–43 are conventional devices commercially available from numerous sources and are used for many applications throughout the construction industry. In operation, one wedge pin is inserted through the superimposed apertures of bracket halves 12 and 14 and a second wedge pin is then inserted through an aperture in the first wedge pin in order to securely engage the first wedge pin in the superimposed apertures.

Figure 2:
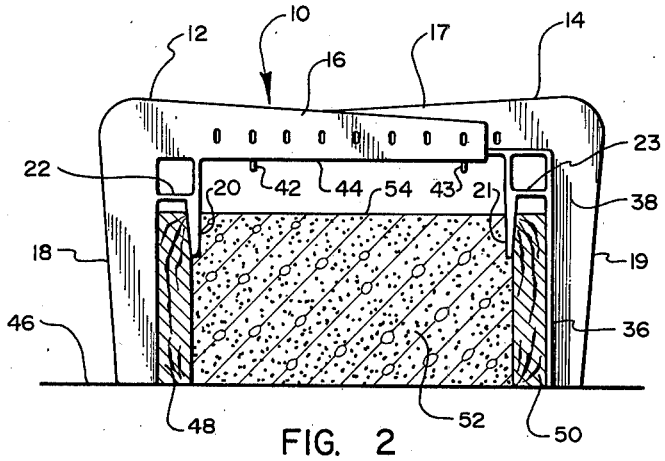
FIG. 2 is a side elevation of the concrete form bracket of FIG. 1 in its configuration to accommodate wide footing form structures.

Referring now more particularly to FIG. 2, the bracket halves 12 and 14 are shown assembled together into a completed bracket 10. Cross arms 16 and 17 are releasably interlocked by wedge pins 40–43 to form a completed crosspiece 44. In this instance, wedge pins 42 and 43 are inserted upwardly through apertures 32 and are thereafter releasably locked therein by the conventional technique of inserting wedge pins 40 and 41 (not shown in FIG. 2) into the apertures in wedge pins 42 and 43. Crosspiece 44 provides the necessary rigidity between the vertically depending legs 18 and 19 which depend outwardly over form walls 48 and 50, respectively.

In this particular illustrated embodiment of FIG. 2, bracket 10 vertically supports form walls 48 and 50 between which a body of concrete 52 has been poured. Legs 18 and 19 rest directly upon the ground surface 46 thereby supporting crosspiece 44 above surface 54 of concrete 52. Crosspiece 44 is supported above surface 54 of concrete 52 so that the person (not shown) finishing the concrete has ready access to surface 54 lying directly under crosspiece 44.

In this particular illustrated configuration, nails may be driven through holes 106 and 107 (FIG. 1) in bracket half 14 and corresponding holes (not shown) in bracket half 12 to releasably attached form walls 50 and 40, respectively, to legs 18 and 19 of bracket 10. Thus, form walls 48 and 50 can be, selectively, held above the ground surface 46 to thereby assist in establishing the grade of the top edge of the footing forms. However, it should be particularly noted that even through legs 18 and 19 rest on ground surface 46 to support the crosspiece 44 above the surface 54 of concrete 52 the flanges 20 and 21 still cooperate with legs 18 and 19, respectively, to retain form walls 48 and 50, respectively, therebetween.

Desirably, concrete 52 is poured in sufficient volume to completely fill the space between and be flush with the top edges of form walls 48 and 50. Accordingly, the grade of the top edge of the footing forms is used to establish the grade of the concrete surface 54.

Figure 3:
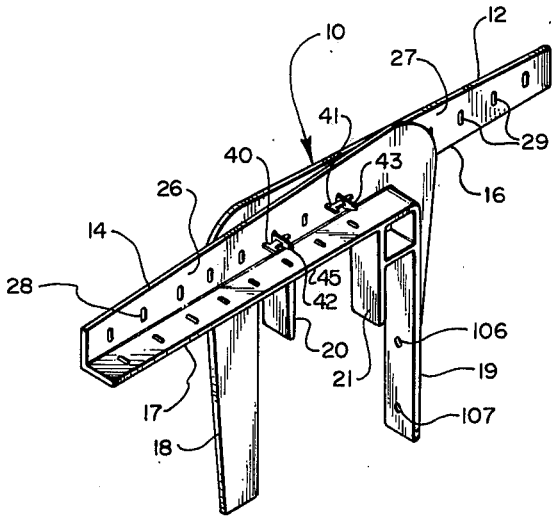
FIG. 3 is a perspective illustration of the bracket of FIG. 1 joined to form a second preferred embodiment for the concrete form bracket of this invention.

Referring now more particularly to FIG. 3, the bracket 10 has been reassembled from the configuration of FIGS. 1 and 2 by bringing the vertical walls 26 and 27 of cross arms 17 and 16, respectively, into juxtaposition with the appropriate apertures 28 and 29, respectively, in alignment. Thereafter, wedge pins 40–43 are inserted to lock bracket halves 12 and 14 together to provide a foreshortened crosspiece 45 thereby permitting a closer spatial adjustment between legs 18 and 19.

Figure 4:
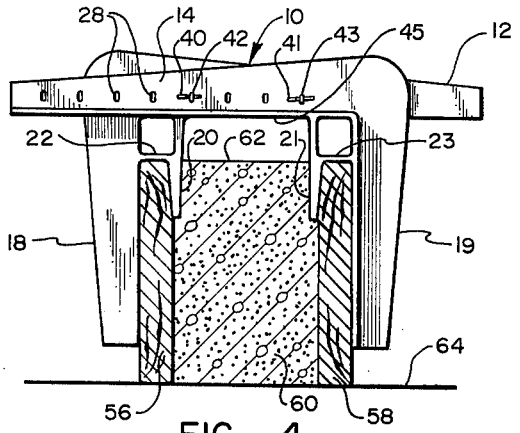
FIG. 4 is a side elevation of the concrete form bracket of FIG. 3 in its configuration to accommodate narrow footing form structures.

Referring now more particularly to FIG. 4, the foreshortened bracket configuration 10 of FIG. 3 is shown in engagement of form walls 56 and 58. Form walls 56 and 58 provide the necessary form structure for a body of concrete 60 which is poured therebetween with a top surface 62 corresponding to and flush with the upper edges of form walls 56 and 58.

In this particular embodiment it should be noted that each of braces 22 and 23 rest directly on the upper edges of form walls 56 and 58, respectively, to support the foreshortened crosspiece 45 above the upper surface 62 of concrete 60 thereby permitting working of the concrete surface immediately under crosspiece 45.

Figure 5:
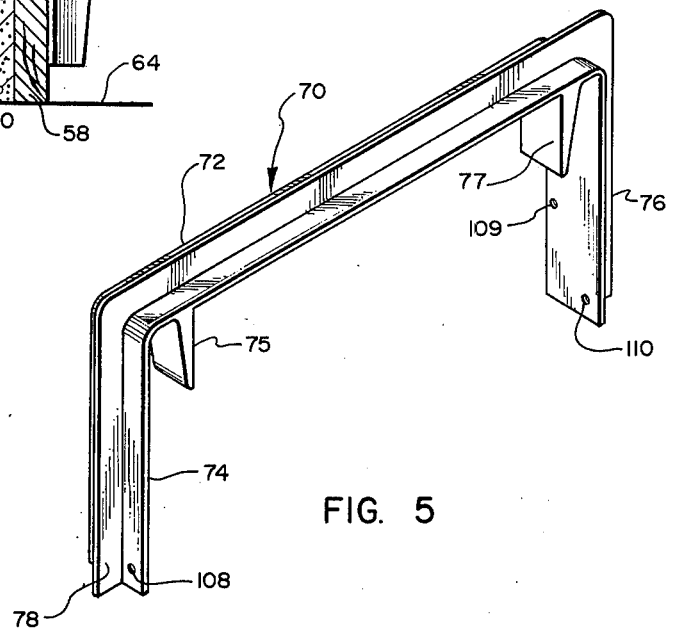
FIG. 5 is a perspective illustration of another embodiment of the bracket of this invention.

Referring now to FIG. 5, a second preferred embodiment of the invention is illustrated as a bracket 70 having a horizontal crosspiece 72 with two downwardly depending legs 74 and 76 at each end thereof. Increased structural strength is imparted to bracket 70, including crosspiece 72 and legs 74 and 76, by fabricating bracket 70 with an upraised backbone portion 78 similar in cross section to conventional "Tee" iron. Clearly, other configurations, besides the Tee iron structure illustrated, including conventional angle irons or channel irons, could also be used to impart the necessary structural rigidity to the bracket 70.

Bracket 70 is fabricated as a unitary, fixed dimension structure for use in construction projects wherein footings of a corresponding width are required. Accordingly, bracket 70 does not have the capability of adjustable widths as the bracket 10 shown in FIGS. 1–4 and is even more inexpensively fabricated. However, bracket 70 could be readily fabricated as an adjustable bracket by utilizing the necessary structural features of bracket 10, FIGS. 1–4.

Bracket 70 includes two downwardly depending flanges 75 and 77 which cooperate with legs 74 and 76, respectively, to engage form walls 82 and 84 (FIG. 6), respectively. Each of flanges 75 and 77 tapers upwardly toward the juncture between the respective leg and crosspiece 72. The taper provides a narrowing of the slot between the two cooperating flange and leg to wedge the form wall thereby. The taper also facilitates extraction of flanges 75 and 77 from the concrete in which they are embedded.

Figure 6:
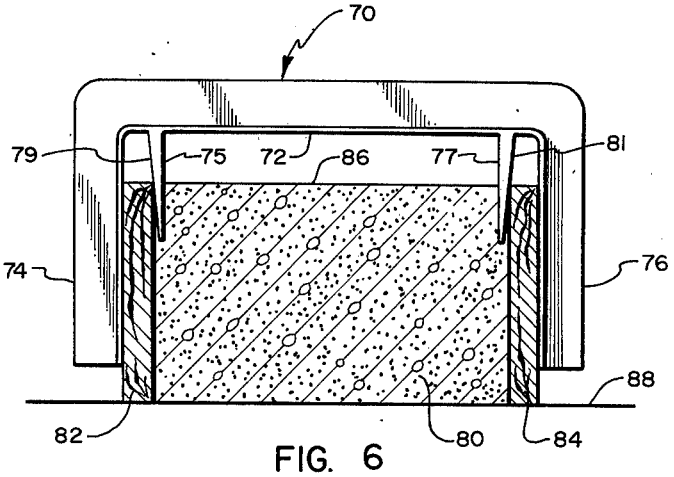
FIG. 6 is a side elevation of the embodiment of FIG. 5.

Referring now more particularly to FIG. 6, bracket 70 is shown in engagement with two vertical form walls 82 and 84 with a body of concrete 80 contained therebetween. It is now more clearly shown that faces 79 and 81 of flanges 75 and 77, respectively, are tapered toward each adjacent leg 74 and 76, respectively, in order to provide a narrowing of the space therebetween and the foregoing wedging action. Accordingly, as bracket 70 is placed upon the form walls 82 and 84, the wedge action created by the narrowing of the space between the corresponding flange and leg securely wedges the form walls 82 and 84 therebetween. The narrowing of the wedge space is sufficient to engage a standard and conventional lumber form wall in a wedging action prior to the top edge of the form wall contacting crosspiece 72. In this manner, the crosspiece 72 is adequately supported above the top surface 86 of concrete 80 while the form walls 82 and 84 are securely engaged by the wedge action of the bracket.

Particular attention is drawn to the feature that legs 74 and 76 may be foreshortened sufficiently so that they do not rest upon the ground surface 88 thereby permitting the bracket 70 to securely engage the form walls 82 and 84 in the wedge action as previously discussed. However, longer legs 74 and 76 could be used to contact the ground while form walls 82 and 84 wedged upwardly as previously discussed and nailed thereto by nails driven through nail holes 108–110 (FIG. 5). Thus, bracket 70 can also readily accommodate establishment of the grade for the footing as described previously with respect to the embodiment of FIGS. 1–4.

Figure 7:
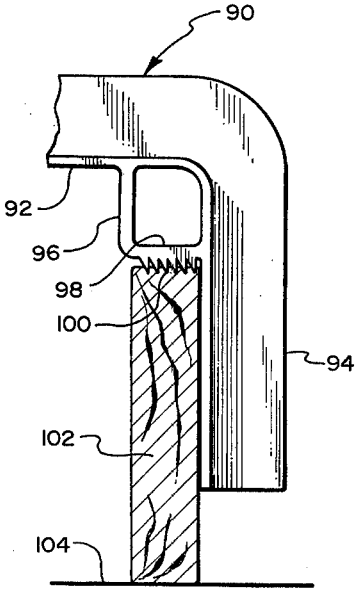
FIG. 7 is a fragmentary side elevation of one end of another embodiment of the bracket of this invention.

Referring now more particularly to FIG. 7, another preferred form wall engaging means is shown on a bracket 90. In particular, bracket 90, which may be configurated as either of the preferred bracket embodiments of FIGS. 1–4 or FIGS. 5 and 6, includes a crosspiece 92 with a downwardly depending leg 94 at one end (the other end of crosspiece 92 and bracket 90 being broken away for purposes of simplicity). A bracket support 96 is formed in the inside angle between crosspiece 92 and depending leg 94 and includes a horizontal brace 98. Brace 98 is parallel to crosspiece 92 and located at an incremental distance therefrom sufficient to permit working of concrete (not shown) placed flush with the top edge of form wall 102. Brace 98 includes form wall engaging means which are shown herein as a plurality of canted teeth 100. Teeth 100 are embedded in the top surface of form wall 102 to prevent its falling inwardly away from leg 94. Teeth 100 engage from wall 102 and thereby eliminate the requirement for a downwardly depending flange which would tend to mar the peripheral configuration of the concrete footing when bracket 90 is removed from the footing forms.

It should be particularly noted that in this particular preferred embodiment of the invention that the leg 94 is a significant distance shorter than the vertical height of form wall 102 to prevent the leg 94 from contacting the ground surface 104 and thereby raising teeth 100 from disengagement with the top of form wall 102. Accordingly, this particular embodiment does not lend itself to establishment of the grade of the footing by use of the bracket unless outside brace 94 is nailed to form wall 102 as set forth hereinabove with respect to the embodiments of FIGS. 1–6.

The Method

The bracket of this invention significantly simplifies the fabrication and removal of concrete footing forms. In particular, the brackets simplify width adjustment and grade establishment while, simultaneously, holding the form walls securely against inadvertent displacement. The practice of the method of this invention significantly reduces the number of wooden cross ties and wooden stakes that must be used while providing greater security to the integrity of the form walls. Furthermore, the bracket crosspiece is supported above the surface of the concrete so as to not interfere with finishing of the concrete surface thereunder.

Although various bracket embodiments are shown, the various features in each embodiment may be readily interchanged with corresponding features of other embodiments to create a bracket having the desired combination of features. Accordingly, a discussion of the method of using the bracket will be conducted in general terms, it being specifically understood that the discussion refers to any combination of features on any one embodiment unless specifically stated otherwise.

To practice the method of using the bracket, the user obtains a plurality of brackets having the desired dimension characteristics and in sufficient quantity to accommodate the particular footing. For example, he will place brackets on the footing forms about every 8 to 10 feet, more or less, depending upon circumstances. This is in distinction to wooden stakes which are driven into the ground about every 2 to 4 feet of linear footing.

The footing is then outlined with form walls which are vertically supported by the brackets of this invention. The brackets are superimposed on the form walls with the legs being on the outside and each support means holding the respective form wall vertically against each leg. The support means also prevents contact between the form wall and the bracket crosspiece so as to support the crosspiece above the surface of concrete contained by the form walls.

Where necessary, grade is established for the top edge of the form wall by placing the end of a leg on the ground and raising the form wall to the desired grade. The form wall is thereafter suitably secured to the leg by nails either singly or in combination with the support means. Stakes may also be used in the event additional height is required beyond that supplied by the bracket leg. In that event, the stake is used to establish the grade while the brackets provide the necessary dimensional integrity to the form walls.

The form created is then filled with concrete and, desirably, leveled flush with the top edges of the form walls. Clearly, a lesser volume of concrete could be used, however, it is much simpler to obtain the correct grade for the concrete by establishing the grade with the top edges of the form walls and making the surface of the concrete flush with the top edges. In this event, finishing the concrete surface is simplified by the novel feature of the bracket of this invention wherein the crosspiece is held above the top edges of the form walls so as to permit ready access to the concrete surface thereunder. Thus, the entire footing surface may be quickly and evenly finished with a uniform surface.

After concrete has suitably hardened, removal of the bracket embodiments of this invention is readily accommodated by, where nailed, removing the nails and the person (not shown) grasping the bracket at any portion of its crosspiece and lifting it vertically from the form walls. This is easily done since the flanges, flanges 20 and 21 (FIGS. 1–4) and flanges 75 and 77 (FIGS. 5 and 6) are preferably tapered downwardly and are thereby easily removed from the concrete.

The invention may be embodied in other specific forms without departing from its spirit or essential characteristics. The described embodiments are to be considered in all respects only as illustrated and not restrictive and the scope of the invention is, therefore, indicated by the appended claims rather than by the foregoing description. All changes which come within the meaning and range of equivalency of the claims are to be embraced within their scope.

We claim:

1. A bracket for holding side form walls for concrete in a fixed relative position comprising:

a horizontal crosspiece;

a vertically depending leg at each end of the crosspiece, each leg being adapted to render vertical support of a form wall engaged by the bracket against forces tending to move the form wall outwardly with respect to the bracket;

an inside support means at each end of the crosspiece inside of the corresponding leg adjacent the angle formed between the crosspiece and the depending leg, the support means accommodating restraining the form wall against forces tending to move the form wall inwardly with respect to the bracket; and means located at each angle formed between the crosspiece and the depending leg and integrally connected to the depending leg and spaced from the crosspiece for supporting the crosspiece an incremental distance above from walls engaged by the legs and the inside support means.

2. A bracket as defined in claim 1 wherein the crosspiece includes length adjustment means to accommodate suitably altering the distance between the legs.

3. A bracket as defined in claim 1 wherein each leg includes at least one hole to accommodate releasably nailing the leg to a form wall.

4. A bracket as defined in claim 1 wherein the inside support means comprises a downwardly depending flange, the flange extending from the crosspiece and tapering downwardly.

5. A bracket as defined in claim 4 wherein the flange is tapered along the surface adjacent the leg to form an inside taper to the flange, the inside taper accommodating wedging of a form wall between the flange and the leg, the taper being of sufficient slope to prevent contact between the top of the form wall and the crosspiece, the wedging action thereby supporting the crosspiece above the form wall.

6. A bracket as defined in claim 1 wherein a cross brace is affixed between the vertically depending leg and the inside support means adjacent the angle between the crosspiece and the vertically depending leg, the cross brace providing structural strength to the inside support means while accommodating supporting the crosspiece above the form walls by contacting the tops of the form walls engaged by the bracket.

7. A bracket for maintaining the vertical and relative relationship between two form walls, the bracket accommodating releasably engaging the upper edges of the form walls while restraining the form walls against inward and outward movement, the bracket comprising:

a first and a second angled member, each member comprising:

a horizontal arm;

a downwardly depending leg attached to one end of the horizontal arm for restraining outward movement of a form wall;

an inside support means attached to the horizontal arm and extending downwardly an incremental distance from the horizontal arm for restraining inward movement of a form wall away from the leg; and a brace located in the angle between the horizontal arm and the leg and an incremental distance from the horizontal arm, the brace extending from the depending leg to the inside support means, the brace adapted to support the horizontal arm above the form wall; and means adjustably joining the horizontal arms together to form a bracket.

* * * * *